US011191695B2

(12) United States Patent
Kim et al.

(10) Patent No.: US 11,191,695 B2
(45) Date of Patent: Dec. 7, 2021

(54) DETACHABLE CRUTCHES AND METHOD OF CONTROLLING THE SAME

(71) Applicants: Hyundai Motor Company, Seoul (KR); Kia Motors Corporation, Seoul (KR)

(72) Inventors: Kye Yoon Kim, Gyeonggi-do (KR); Ji Min Han, Gyeonggi-Do (KR); Seok Young Youn, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 575 days.

(21) Appl. No.: 16/207,101

(22) Filed: Dec. 1, 2018

(65) Prior Publication Data

US 2020/0078256 A1 Mar. 12, 2020

(30) Foreign Application Priority Data

Sep. 6, 2018 (KR) ..... 10-2018-0106646

(51) Int. Cl.
*A61H 3/00* (2006.01)
*A61H 3/02* (2006.01)

(52) U.S. Cl.
CPC ..... *A61H 3/02* (2013.01); *A61H 3/00* (2013.01); *A61H 2003/006* (2013.01); *A61H 2201/165* (2013.01); *A61H 2201/1635* (2013.01); *A61H 2201/1671* (2013.01); *A61H 2201/5064* (2013.01)

(58) Field of Classification Search
CPC ..... A61H 3/02; A61H 3/00; A61H 2003/006; A61H 2201/1635; A61H 2201/165; A61H 2201/1671; A61H 2201/5064; A61H 2003/0205; A61H 2003/0211; A61H 2003/0216; A61H 2003/0222; A61H 2003/0227; A61H 2003/0233; A61H 2003/0238; A61H 3/0244; A61H 2003/025; A61H 2003/0255; A61H 2003/0261; A61H 2003/0266; A61H 2003/0272; A61H 3/0277; A61H 2003/0283; A61H 3/0288; A61H 2003/0294

See application file for complete search history.

(56) References Cited

U.S. PATENT DOCUMENTS 6,561,206 B1 * 5/2003 Wilkinson ..... A61H 3/0244 135/65

FOREIGN PATENT DOCUMENTS

| | | | |
|---|---|---|---|
| JP | 2005-058713 | A | 3/2005 |
| JP | 2006-087534 | A | 4/2006 |
| KR | 10-2017-0040454 | A | 4/2017 |

* cited by examiner

*Primary Examiner* — Tu A Vo
(74) *Attorney, Agent, or Firm* — Mintz Levin Cohn Ferris Glovsky and Popeo, P.C.; Peter F. Corless

(57) ABSTRACT

A pair of detachable crutches extends in a longitudinal direction, where each of the detachable crutches includes a metal ball having magnetic properties and a holder having magnetic properties. A magnetic force is generated between the metal ball provided at one of the crutches and the holder provided at the other one of the crutches so as to maintain attachment therebetween. Each of the crutches further includes a sensor configured to sense whether the metal ball and the holder have been attached to each other.

15 Claims, 4 Drawing Sheets

DETACHABLE CRUTCHES AND METHOD OF CONTROLLING THE SAME

CROSS-REFERENCE TO RELATED APPLICATION

This application claims under 35 U.S.C. § 119(a) the benefit of Korean Patent Application No. 10-2018-0106646, filed on Sep. 6, 2018 in the Korean Intellectual Property Office, the entire contents of which are incorporated herein by reference.

BACKGROUND

1. Technical Field

The present disclosure relates to detachable crutches and a method of controlling the same, more particularly to a pair of detachable crutches interlocked with a wearable robot, in which one of the detachable crutches is capable of being detachably attached to the other one.

2. Description of the Related Art

Wearable robots that supplement the lower-body strength of injured or disabled persons, the elderly, or the like have been developed. In addition, crutches, which operate synchronously with the operation of the wearable robots in order to assist the same, have been developed.

In general, a pair of crutches is provided to support both arms of the wearer so that the wearer may stably lean on the crutches while holding the same with both arms.

However, when the wearer needs to freely use one arm while walking using a pair of crutches, the wearer has difficulty holding a corresponding unused crutch. That is, the wearer has difficulty releasing one of the pair of crutches and grasping only the other crutch.

In addition, when grasping the other crutch, the wearer is likely to inadvertently manipulate a manipulation unit provided at a handgrip of the crutch.

The information disclosed in this Background section is only for enhancement of understanding of the general background of the disclosure and should not be taken as an acknowledgement or any form of suggestion that this information forms the prior art already known to a person skilled in the art.

SUMMARY

Therefore, the present disclosure provides a pair of crutches, which may allow a wearer to release one of the pair of crutches and to grasp only the other crutch by attaching the released crutch to the other crutch.

In accordance with the present disclosure, the above and other objects can be accomplished by the provision of a pair of detachable crutches extending in a longitudinal direction thereof, each of the detachable crutches including: a metal ball having magnetic properties; a holder having magnetic properties, wherein a magnetic force is generated between the metal ball provided at one of the crutches and the holder provided at a remaining one of the crutches so as to maintain attachment therebetween; and a sensor configured to sense whether the metal ball and the holder have been attached to each other.

Each of the crutches may further include an arm support, extending from an upper end portion of each crutch, and a handgrip disposed under the arm support and extending outwards in the longitudinal direction. The upper end portion may extend in both lateral directions so as to surround a portion of a wearer's forearm.

The handgrip and the arm support may be integrally formed with each other and may be rotatably coupled to each of the crutches.

The holder may be disposed on the outer surface of the arm support that is located at a side of the wearer's forearm, and the metal ball may be coupled to the upper end portion of each of the crutches.

The metal ball may be coupled to the arm support via a strap so that a relative position between the metal ball and the crutches is variable.

Each of the crutches may further include a handgrip, extending outwards in the longitudinal direction, and a manipulation unit provided at the handgrip of at least one of the crutches. The manipulation unit may include buttons for controlling the operation of at least one of a wearable robot or the crutches worn on the wearer. When the sensor senses that the metal ball and the holder have been attached to each other, the buttons of the manipulation unit may be deactivated.

The metal ball and the holder may be permanent magnets configured to generate a magnetic force to attract each other, and the sensor may be an electromagnetic wave sensor configured to sense an electromagnetic wave that varies depending on attachment or detachment of the metal ball and the holder from each other.

The metal ball may include protruding portions coupled to the outer surface thereof via elastic members, and the holder may include receiving recesses into which the protruding portions are inserted when the metal ball is attached to the holder. The sensor may sense current flowing through electric wires connected to two opposite sides of the holder when the protruding portions are inserted into the receiving recesses, thereby sensing attachment or detachment of the metal ball and the holder from each other.

Each of the crutches may further include a handgrip, extending outwards in the longitudinal direction, and a manipulation unit provided at the handgrip of at least one of the crutches. The manipulation unit may include buttons for controlling the operation of at least one of a wearable robot or the crutches worn on the wearer. Any one of the metal ball and the holder may be formed as an electromagnet so that a magnetic force between the metal ball and the holder is changed by the manipulation unit.

According to another aspect of the present disclosure, a method of controlling a pair of detachable crutches can include: providing the pair of detachable crutches, each of the detachable crutches comprising: a metal ball having magnetic properties; a holder having magnetic properties, wherein a magnetic force is generated between the metal ball provided at one of the crutches and the holder provided at a remaining one of the crutches so as to maintain attachment therebetween; and a sensor configured to sense whether the metal ball and the holder have been attached to each other; sensing, by the sensor, whether the metal ball provided at one of the crutches and the holder provided at the remaining one of the crutches have been attached to each other; and when attachment of the metal ball and the holder to each other is sensed, deactivating a button for controlling operation of at least one of a wearable robot or the crutches worn on a wearer, the button being provided at a handgrip formed so as to extend outwards from the one of the crutches in the longitudinal direction.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE PREFERRED EMBODIMENTS

Figure 1:
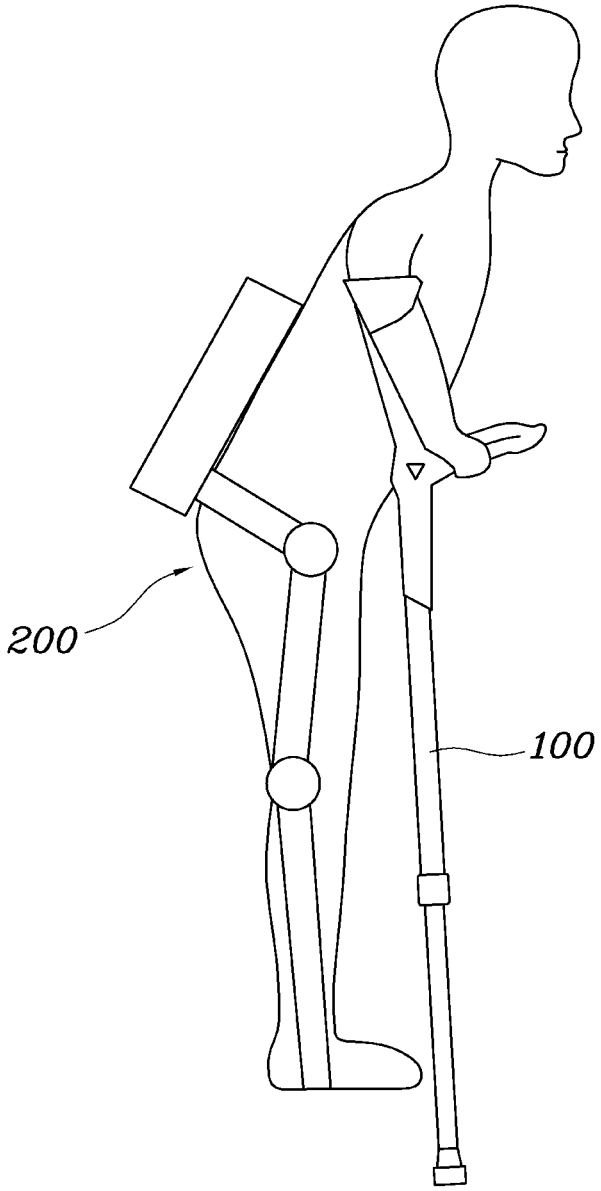
FIG. 1 is a view illustrating the state in which a wearer wears detachable crutches according to an embodiment of the present disclosure.

Various exemplary embodiments will now be described more fully with reference to the accompanying drawings, in which only some exemplary embodiments are shown. Specific structural and functional details disclosed herein are merely representative for the purpose of describing exemplary embodiments. The present disclosure, however, may be embodied in many alternate forms and should not be construed as being limited only to the exemplary embodiments set forth herein.

Accordingly, while exemplary embodiments of the disclosure are capable of being variously modified and taking alternative forms, embodiments thereof are shown by way of example in the drawings and will herein be described in detail. It should be understood, however, that there is no intent to limit the present disclosure to the particular exemplary embodiments disclosed. On the contrary, exemplary embodiments are to cover all modifications, equivalents, and alternatives falling within the scope of the disclosure.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of exemplary embodiments of the present disclosure.

It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent" etc.).

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Unless otherwise defined, all terms used herein, which include technical or scientific terms, have the same meanings as those generally appreciated by those skilled in the art. The terms, such as ones defined in common dictionaries, should be interpreted as having the same meanings as terms in the context of pertinent technology, and should not be interpreted as having ideal or excessively formal meanings unless clearly defined in the specification.

Reference will now be made in detail to the preferred embodiments of the present disclosure, examples of which are illustrated in the accompanying drawings. Wherever possible, the same reference numbers will be used throughout the drawings to refer to the same or like parts.

Figure 2:
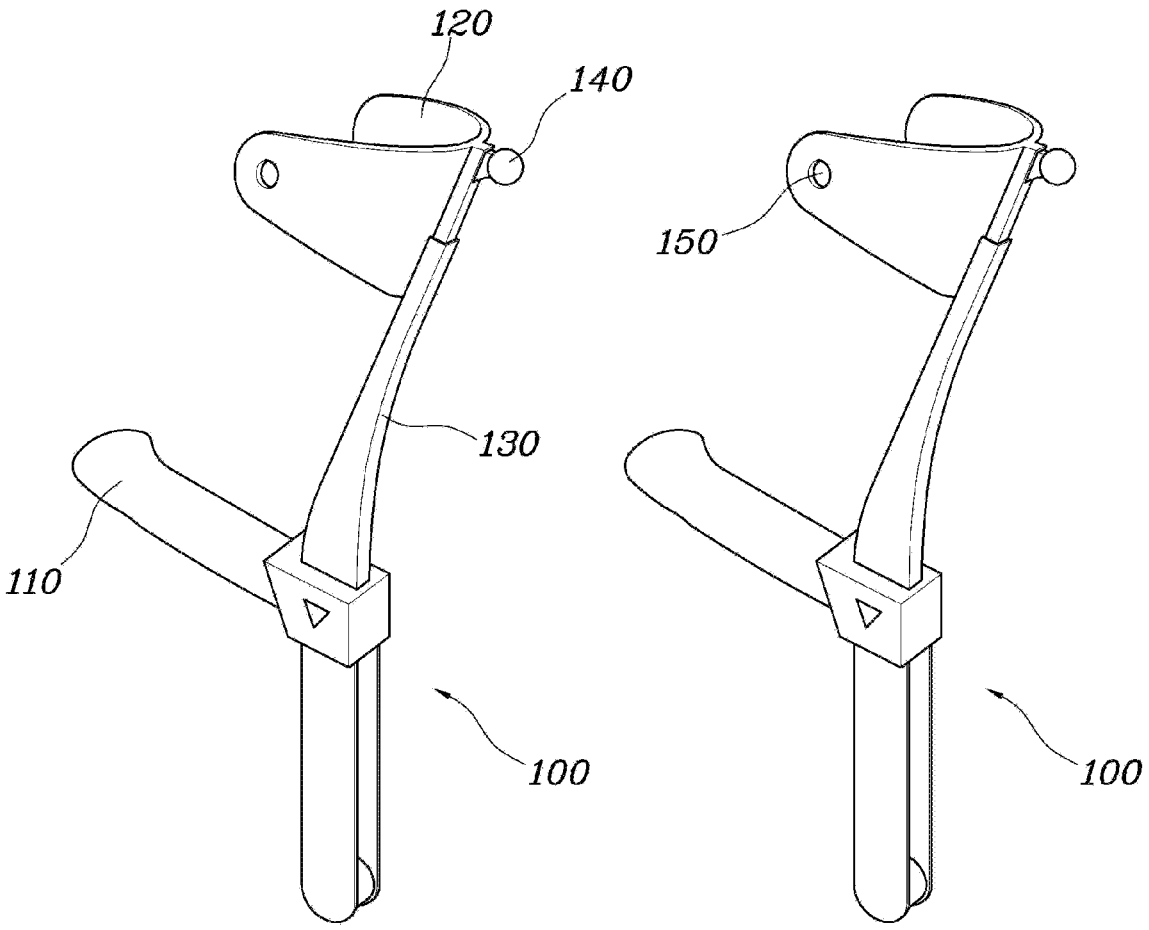
FIG. 2 is a perspective view of detachable crutches according to an embodiment of the present disclosure.

FIG. 1 is a view illustrating the state in which a wearer wears detachable crutches according to an embodiment of the present disclosure, and FIG. 2 is a perspective view of detachable crutches according to an embodiment of the present disclosure.

Referring to FIGS. 1 and 2, a pair of detachable crutches 100 according to an embodiment of the present disclosure is provided, where each of the crutches extends in a longitudinal direction thereof. Each of the crutches 100 includes a metal ball 140 having magnetic properties and a holder 150 having magnetic properties. A magnetic force is generated between the metal ball 140 provided at one of the crutches 100 and the holder 150 provided at the other one of the crutches 100 so as to maintain attachment therebetween. Each of the crutches 100 further includes a sensor 180 for sensing whether the metal ball 140 and the holder 150 have been attached to each other.

In particular, the crutch is essentially a stick that a wearer holds with the arm to help the wearer walk. In general, a pair of crutches is provided so that the wearer holds the same with both arms.

Each of the pair of crutches 100 may extend in the longitudinal direction thereof such that the lower end portion thereof contacts the ground and the upper end portion thereof supports the wearer's forearm. The wearer's forearm typically refers to the body part extending from the elbow to the wrist of the wearer. In another embodiment, each of the crutches 100 may extend so as to fit under the wearer's armpit to support the wearer's weight.

Each of the crutches 100 may include a metal ball 140 having magnetic properties and a holder 150 having magnetic properties. Each of the metal ball 140 and the holder 150 may be made of a magnetic material. Thus, when the metal ball 140 and the holder 150 are brought close to each other, a magnetic attractive force may be generated therebetween. That is, the metal ball 140 provided at one of the crutches 100 and the holder 150 provided at the other one of the crutches 100 may be securely attached to each other by the magnetic force generated therebetween.

The metal ball 140 may be formed to have a completely or partially spherical shape, or may alternatively be smoothly rounded so as to be inserted in any direction.

The holder 150 may have a shape corresponding to the shape of the metal ball 140, or may alternatively have the shape of a recess that is smoothly rounded so as to correspond to the outer surface of the metal ball 140.

The sensor 180 may sense whether the metal ball 140 and the holder 150 have been attached to each other. That is, the pair of crutches 100 may be attached to each other by the magnetic force generated between the metal ball 140 and the holder 150, and may be detached from each other by an external force. The sensor 180 may sense whether the metal ball 140 and the holder 150 have been attached to each other.

Therefore, according to the detachable crutches 100 of the present disclosure, while grasping only one of the crutches 100, the wearer may attach the other one of the crutches 100 to the crutch that the wearer is grasping.

Each of the crutches 100 may include an arm support 120, which extends from the upper end portion of the crutch 100 in both lateral directions so as to surround a portion of the wearer's forearm, and a handgrip 110, which is disposed under the arm support 120 and extends outwards in the longitudinal direction of the crutch 100. The extending direction of the handgrip may be any angle between a direction perpendicular to the longitudinal direction and a direction upward to the longitudinal direction.

The arm support 120 may extend in both lateral directions so as to surround the wearer's forearm. The handgrip 110 may be provided at a position where the wearer's hand is located under the arm support 120. The handgrip 110 may extend outwards in the longitudinal direction of the crutch 100 in consideration of the angle of the wrist. Thus, the wearer may support his/her own weight by grasping the handgrip 110.

The handgrip 110 and the arm support 120 may be integrally formed with each other, and may be rotatably coupled to the crutch 100. In particular, the handgrip 110 and the arm support 120 may be integrally formed with a connecting portion 130, which is provided above the handgrip 110 in order to connect the arm support 120 to the crutch 100. The handgrip 110, the arm support 120 and the connecting portion 130, which are integrated in a single body, may be rotatably coupled to the upper end portion of the crutch 100. In addition, the crutch 100 may further include a fixing unit (not illustrated) for restricting rotation of the handgrip 110, the arm support 120 and the connecting portion 130 with respect to the crutch 100.

Accordingly, the angles of the handgrip 110 and the arm support 120 may vary in response to a posture change of the wearer between a sitting position and a standing position, a walking posture, or a grasping posture, with the result that the wearer will feel a minimized foreign body sensation when wearing the crutch 100.

Specifically, the holder 150 may be disposed on the outer surface of the arm support 120 that is located at the side of the wearer's forearm, and the metal ball 140 may be coupled to the upper end portion of the crutch 100.

That is, as illustrated in FIG. 2, the holder 150 may be located on the outer surface of the arm support 120, particularly, at the side of the wearer's forearm. The holder 150 may be located at each of both sides of the wearer's forearm. That is, a plurality of holders 150 may be provided at each of the crutches 100.

Alternatively, in the case in which the pair of crutches 100 is provided to include a left crutch and a right crutch, the holder 150 may be located only at the outer side of each of the wearer's forearms. Accordingly, when one of the crutches 100 is attached to the other one of the crutches 100, the attached crutch may be located at the outer side of the wearer, thereby minimizing interference with the motion of the wearer.

The metal ball 140 may be coupled to the upper end portion of the crutch 100. Accordingly, when one of the crutches 100 is attached to the other one of the crutches 100 due to the magnetic force generated between the metal ball 140 provided at the one of the crutches 100 and the holder 150 provided at the other one of the crutches 100, the angle at which the attached crutch is inclined with respect to an axial direction perpendicular to the ground surface is small, with the result that the attachment may be securely maintained even when the magnitude of the magnetic force between the metal ball 140 and the holder 150 is small.

Particularly, the metal ball 140 may be located at the center of the arm support 120, which extends in both lateral directions. That is, the metal ball 140 may be directly coupled to the crutch 100, which extends in the longitudinal direction thereof, without being biased to a side of the arm support 120, rather than being coupled to the arm support 120. In addition, in order to minimize the interference with the outside when the metal ball 140 and the holder 150 are attached to each other, the metal ball 140 may be formed so as to protrude upwardly or laterally from the upper end portion of the crutch 100.

Figure 3:
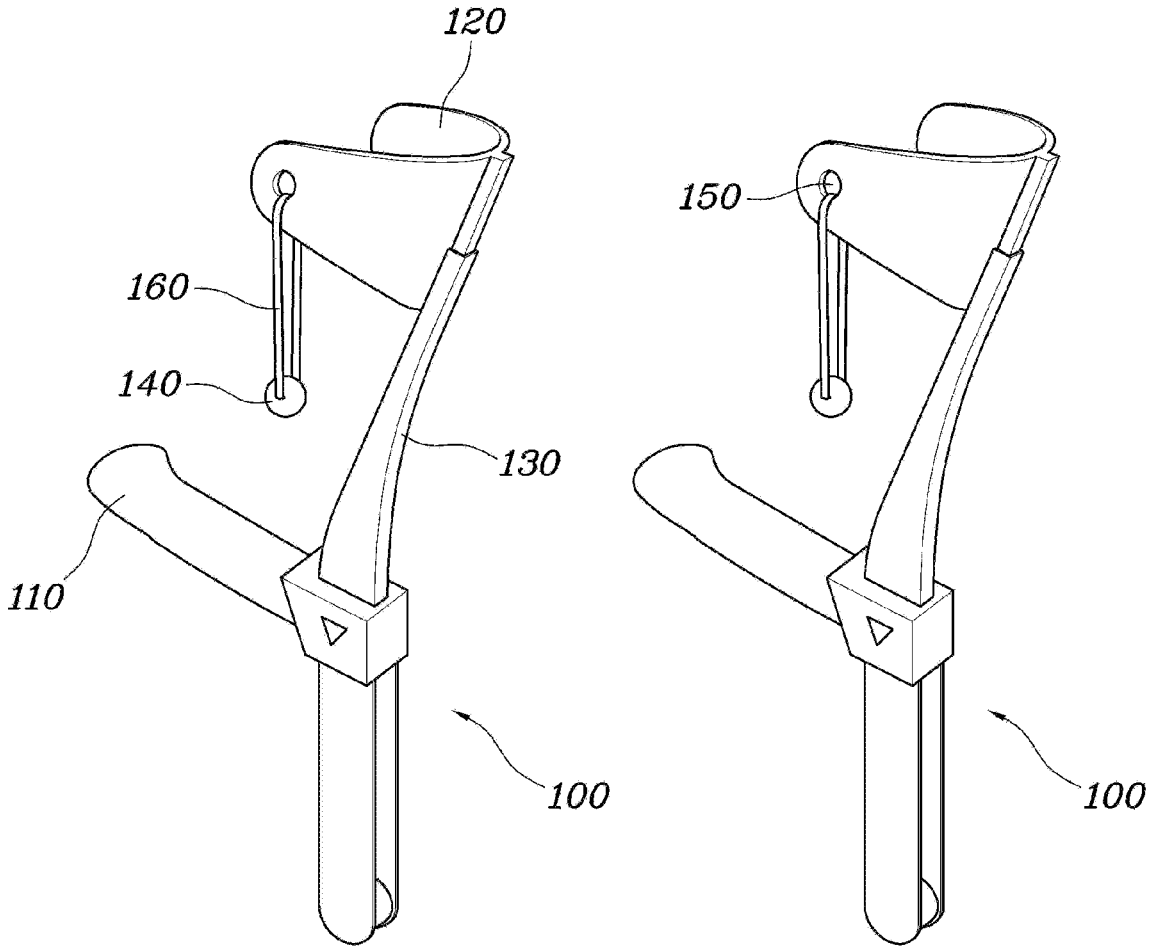
FIG. 3 is a perspective view of detachable crutches according to another embodiment of the present disclosure.

FIG. 3 is a perspective view of detachable crutches according to another embodiment of the present disclosure.

Referring to FIG. 3, each of detachable crutches 100 according to another embodiment of the present disclosure may be configured such that a metal ball 140 is connected to an arm support 120 via a strap 160. Thus, the position of the metal ball 140 relative to the crutch 100 may vary to a certain extent.

In particular, a separate strap 160 may be coupled to the arm support 120, and the metal ball 140 may be coupled to the strap 160. Thus, the metal ball 140 may be coupled to the crutch 100 so as to be movable relative to the crutch 100 to a certain extent. Accordingly, even when the metal ball 140 is attached to the holder 150, the attached crutch 100 may have a certain degree of freedom as to movement relative to the crutch 100 grasped by the wearer.

In addition, when the wearer wears the crutch 100, the strap 160 may be worn around the wearer's forearm or upper arm, thereby allowing the wearer to securely hold the crutch 100.

Figure 4:
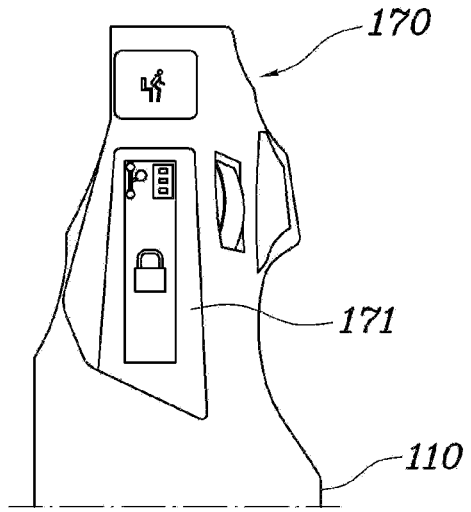
FIG. 4 is a top view of a manipulation unit according to an embodiment of the present disclosure.

FIG. 4 is a top view of a manipulation unit according to an embodiment of the present disclosure.

Referring to FIG. 4, at least any one of the pair of crutches 100 according to the embodiment of the present disclosure may include a manipulation unit 170, which is provided at the handgrip 110 and includes buttons for controlling the operation of at least one of the wearable robot 200 or the crutch 100 worn on the wearer.

The wearer may wear the wearable robot 200 separately from the crutch 100. The wearable robot 200 may be worn on the wearer's legs in order to help the wearer walk. Particularly, the wearable robot 200 worn on the wearer's legs may be operated so as to assist walking or standing-up of the wearer.

The manipulation unit 170 may be provided at the handgrip 110 of at least one of the crutches 100 in order to control the operation of the wearable robot 200. The manipulation unit 170 may include a screen 171 for displaying the operating state of the wearable robot 200 or buttons configured to receive a touch input from the wearer. In addition to the screen 171, the manipulation unit 170 may further include buttons configured to receive a push input from the wearer.

The manipulation unit 170 may be provided only at any one of the pair of crutches 100, or may be provided at both of the pair of crutches 100.

In addition, the wearer may control the operation of the crutch 100 via the manipulation unit 170. Specifically, using the manipulation unit 170, the wearer may control the operation of the fixing unit (not illustrated) in order to fix or change the angles at which the handgrip 110 and the arm support 120 are rotated with respect to the upper end portion of the crutch 100, as described above, or to control the magnetic force generated between the holder 150 and the metal ball 140, which will be described later.

When the sensor 180 senses that the metal ball 140 and the holder 150 have been attached to each other, the buttons of the manipulation unit 170 may be deactivated. Specifically, when the sensor 180 senses that the metal ball 140 and the holder 150 have been attached to each other, that is, that one of the crutches 100 has been attached to the other one of the crutches 100, the manipulation unit 170 may be controlled so as to be deactivated.

Deactivation of the buttons may include the state in which the buttons are locked so that they are impossible to manipulate or the state in which the manipulation unit 170 is controlled such that it does not recognize the manipulation of the buttons by the wearer even when the manipulation of the buttons is possible.

When the wearer attaches one of the crutches 100 to the other one of the crutches 100, the wearer grasps the handgrip 110 of the other crutch with an increased force, and thus is likely to inadvertently manipulate the manipulation unit 170. In addition, in this situation, the wearer is not wearing at least one of the crutches 100, and thus is not stably supported by the crutches 100. At this time, it is not necessary to control the crutches 100 such that they assist walking of the wearer. If the crutches 100 are controlled to assist walking of the wearer in the above situation, this will cause a dangerous situation. Therefore, the buttons may be controlled such that they are deactivated.

The sensor 180 may have a physical structure or an electromagnetic constitution or may be implemented as an electromagnetic sensor 180 so as to sense whether the metal ball 140 and the holder 150 have been attached to each other.

In one embodiment, the metal ball 140 and the holder 150 may be permanent magnets that generate a magnetic force to attract each other. That is, the metal ball 140 and the holder 150 may be permanent magnets that generate a magnetic attractive force therebetween at all times. In this case, the sensor 180 may be an electromagnetic wave sensor 180 configured to sense an electromagnetic wave, which varies depending on attachment or detachment of the metal ball 140 and the holder 150 from each other.

Since the metal ball 140 and the holder 150 have magnetic properties, it may be possible to sense whether the metal ball 140 has been inserted into the holder 150 by sensing On/Off states using the electromagnetic sensor 180. The electromagnetic sensor 180 may sense a dielectric constant at the time of attachment/detachment of the magnetic objects, or may sense resistance, inductance or capacitance using a coil.

In another embodiment, the holder 150 may be provided with a hook switch, which is turned on or off depending on attachment or detachment of the metal ball 140 from the holder 150. Accordingly, when the metal ball 140 is attached to the holder 150, the hook switch may be closed to activate a circuit.

When the metal ball 140 is attached to the holder 150, the hook switch is turned on, and current flows through an electric wire. Thus, the sensor 180 may sense whether the metal ball 140 has been attached to the holder 150 by sensing the current flowing through the electric wire.

That is, it may be possible to sense the insertion of the metal ball 140 into the holder 150 using the physical structure such as the hook switch provided between the metal ball 140 and the holder 150. In particular, the hook switch may have the same structure as a hook switch of a telephone, which is configured to be pressed by a receiver of the telephone.

Figure 5:
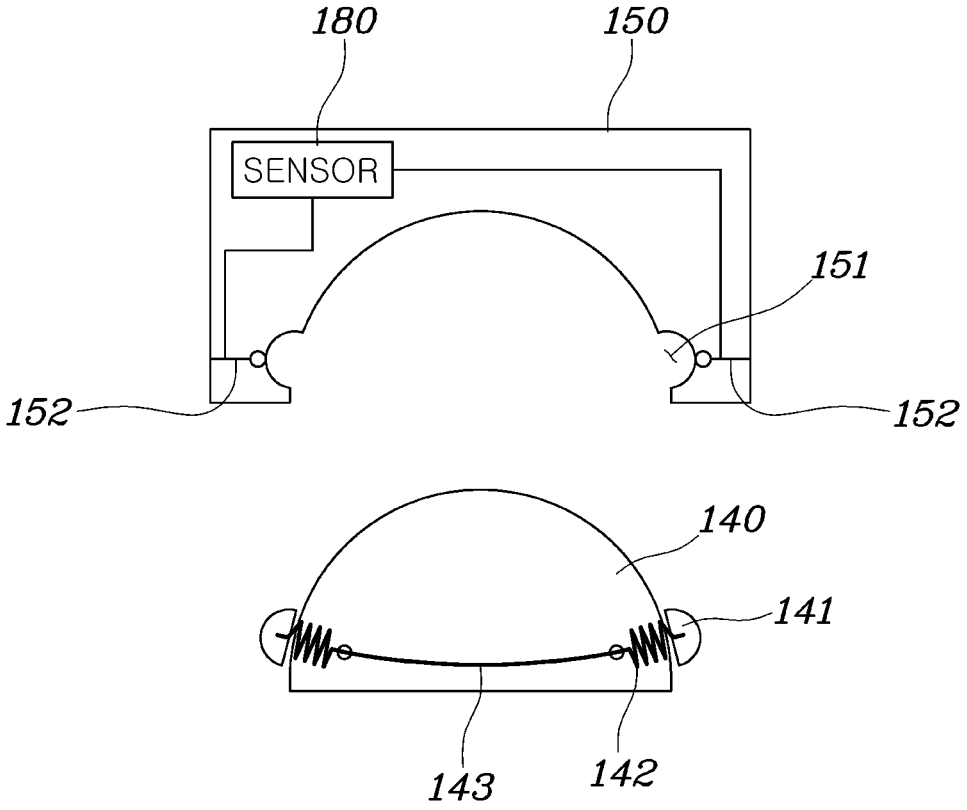
FIG. 5 is a cross-sectional view of a metal ball and a holder according to an embodiment of the present disclosure.

FIG. 5 is a cross-sectional view of the metal ball and the holder according to an embodiment of the present disclosure.

Referring to FIG. 5, the metal ball 140 may include protruding portions 141, each of which is coupled to the outer surface of the metal ball 140 via an elastic member 142, and the holder 150 may include receiving recesses 151, into which the protruding portions 141 of the metal ball 140 are inserted when the metal ball 140 is attached to the holder 150. That is, the protruding portions 141 may be connected to the outer surface of the metal ball 140 via the elastic members 142 (e.g. springs) so as to be movable relative to the outer surface of the metal ball 140.

Accordingly, when the metal ball 140 is attached to the holder 150, the protruding portions 141 of the metal ball 140 may be smoothly inserted into the receiving recesses 151 in the holder 150 by the elastic force of the elastic members 142.

When the protruding portions 141 of the metal ball 140 are inserted into the receiving recesses 151 in the holder 150, current flows through an electric wire 152 provided in the holder 150. The electric wire 152 is divided into two parts, which are disposed in two opposite sides of the holder 150. The sensor 180 may sense whether the metal ball 140 has been attached to the holder 150 by sensing the current flowing through the electric wire 152 in the holder 150. The metal ball 140 may also be provided therein with an electric wire 143, through which current can flow. When the metal ball 140 is inserted into the holder 150, the electric wire 143 in the metal ball 140 may electrically connect the two divided parts of the electric wire 152 in the holder 150 to each other. Therefore, the sensor 180 may sense the current flowing through the electric wires connected to the two opposite sides of the holder 150, thereby sensing whether the metal ball 140 has been attached to the holder 150 based on the magnitude of the current.

In addition, the metal ball 140 or the holder 150 may be formed as an electromagnet, and thus the magnetic force between the metal ball 140 and the holder 150 may be changed by the manipulation unit 170. An electromagnet is a magnet having a variable magnetic force depending on the supply or interruption of current or depending on the magnitude of current. The manipulation unit 170 may be provided with a button for changing the magnitude of the magnetic force of the metal ball 140 or the holder 150 or controlling the supply or interruption of magnetic force.

Accordingly, when the wearer intends to attach one of the crutches 100 to the other one of the crutches 100, the wearer may manipulate the manipulation unit 170 so that a magnetic force is applied, thereby selectively generating a magnetic force between the metal ball 140 and the holder 150.

In addition, the manipulation unit 170 may determine whether the metal ball 140 has been attached to the holder 150 through the sensor 180. Upon determining that the metal ball 140 has been attached to the holder 150, the manipulation unit 170 may inform the wearer of the attachment by displaying information related thereto on a screen thereof or using a vibration motor or a speaker provided in the crutches 100. In a similar way, when the metal ball 140 and the holder 150 are detached from each other, the information related thereto may also be provided to the wearer.

A method of controlling the detachable crutches according to an embodiment of the present disclosure may include the steps of sensing, by the sensor, whether the metal ball provided at one of the crutches and the holder provided at the other one of the crutches have been attached to each other, and, when the attachment of the metal ball and the holder to each other is sensed, deactivating a button for controlling the operation of at least one of the wearable robot or the crutches worn on the wearer, which is provided at a handgrip formed so as to extend outwards from at least any one of the pair of crutches in the longitudinal direction of the crutches.

In one embodiment, as described above, the metal ball and the holder are formed as permanent magnets that generate a magnetic force to attract each other, and the sensor is an electromagnetic wave sensor configured to sense an electromagnetic wave. In the step of sensing whether the metal ball and the holder have been attached to each other, the electromagnetic wave sensor may sense an electromagnetic wave that varies depending on attachment or detachment of the metal ball and the holder from each other.

In another embodiment, the metal ball includes protruding portions coupled to the outer surface of the metal ball via elastic members, and the holder includes receiving recesses into which the protruding portions of the metal ball are inserted when the metal ball is attached to the holder. In the step of sensing whether the metal ball and the holder have been attached to each other, the sensor may sense current flowing through electric wires connected to two opposite sides of the holder when the protruding portions are inserted into the receiving recesses, thereby sensing attachment or detachment of the metal ball and the holder from each other.

In a further embodiment, the holder is provided with a hook switch, which is turned on or off depending on attachment or detachment of the metal ball from the holder. In the step of sensing whether the metal ball and the holder have been attached to each other, the sensor may sense current flowing through an electric wire when the hook switch is turned on with the attachment of the metal ball to the holder, thereby sensing attachment or detachment of the metal ball and the holder from each other.

As is apparent from the above description, the present disclosure provides a pair of crutches, which may allow a wearer to release any one of the pair of crutches and to grasp only the other crutch by attaching the released crutch to the other crutch.

In addition, it is possible to sense whether any one of the pair of crutches has been attached to the other one of the pair of crutches and to prevent a manipulation unit from being inadvertently manipulated by deactivating the manipulation unit.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A pair of detachable crutches extending in a longitudinal direction thereof, each of the detachable crutches comprising:

a metal ball having magnetic properties;

a holder having magnetic properties, wherein a magnetic force is generated between the metal ball provided at one of the crutches and the holder provided at a remaining one of the crutches so as to maintain attachment therebetween; and a sensor configured to sense whether the metal ball and the holder have been attached to each other.

2. The detachable crutches according to claim 1, wherein each of the crutches further comprises an arm support, extending from an upper end portion of each crutch, and a handgrip disposed under the arm support and extending outwards in the longitudinal direction.

3. The detachable crutches according to claim 2, wherein the arm support extends from the upper end portion of each crutch in both lateral directions so as to surround a portion of a wearer's forearm.

4. The detachable crutches according to claim 2, wherein the handgrip and the arm support are integrally formed with each other and are rotatably coupled to each of the crutches.

5. The detachable crutches according to claim 2, wherein the holder is disposed on an outer surface of the arm support that is located at a side of a wearer's forearm, and wherein the metal ball is coupled to the upper end portion of each of the crutches.

6. The detachable crutches according to claim 5, wherein the metal ball is coupled to the arm support via a strap so that a relative position between the metal ball and the crutches is variable.

7. The detachable crutches according to claim 1, wherein each of the crutches further comprises a handgrip, extending outwards in the longitudinal direction, and a manipulation unit provided at the handgrip, wherein the manipulation unit comprises buttons for controlling operation of at least one of a wearable robot or the crutches worn on a wearer, and wherein, when the sensor senses that the metal ball and the holder have been attached to each other, the buttons of the manipulation unit are deactivated.

8. The detachable crutches according to claim 1, wherein the metal ball and the holder are permanent magnets configured to generate a magnetic force to attract each other, and wherein the sensor is an electromagnetic wave sensor configured to sense an electromagnetic wave that varies depending on attachment or detachment of the metal ball and the holder from each other.

9. The detachable crutches according to claim 1, wherein the metal ball comprises protruding portions coupled to an outer surface thereof via elastic members, wherein the holder comprises receiving recesses into which the protruding portions are inserted when the metal ball is attached to the holder, and wherein the sensor senses current flowing through electric wires connected to two opposite sides of the holder when the protruding portions are inserted into the receiving recesses, thereby sensing attachment or detachment of the metal ball and the holder from each other.

10. The detachable crutches according to claim 1, wherein each of the crutches further comprises a handgrip, extending outwards in the longitudinal direction, and a manipulation unit provided at the handgrip, wherein the manipulation unit comprises buttons for controlling operation of at least one of a wearable robot or the crutches worn on a wearer, and wherein one of the metal ball and the holder is formed as an electromagnet so that a magnetic force between the metal ball and the holder is changed by the manipulation unit.

11. The detachable crutches according to claim 1, wherein the holder is provided with a hook switch configured to be turned on or off depending on attachment or detachment of the metal ball from the holder, and wherein the sensor senses current flowing through an electric wire when the hook switch is turned on with attachment of the metal ball to the holder, thereby sensing attachment or detachment of the metal ball and the holder from each other.

12. A method of controlling a pair of detachable crutches, the method comprising:

providing the pair of detachable crutches, each of the detachable crutches comprising:

a metal ball having magnetic properties;

a holder having magnetic properties, wherein a magnetic force is generated between the metal ball provided at one of the crutches and the holder provided at a remaining one of the crutches so as to maintain attachment therebetween; and a sensor configured to sense whether the metal ball and the holder have been attached to each other;

sensing, by the sensor, whether the metal ball provided at one of the crutches and the holder provided at the remaining one of the crutches have been attached to each other; and when attachment of the metal ball and the holder to each other is sensed, deactivating a button for controlling operation of at least one of a wearable robot or the crutches worn on a wearer, the button being provided at a handgrip formed so as to extend outwards from the one of the crutches in the longitudinal direction.

13. The method according to claim 12, wherein the metal ball and the holder are formed as permanent magnets that generate a magnetic force to attract each other, wherein the sensor is an electromagnetic wave sensor configured to sense an electromagnetic wave, and wherein, in the sensing, the electromagnetic wave sensor senses an electromagnetic wave that varies depending on attachment or detachment of the metal ball and the holder from each other.

14. The method according to claim 12, wherein the metal ball comprises protruding portions coupled to an outer surface thereof via elastic members, wherein the holder comprises receiving recesses into which the protruding portions are inserted when the metal ball is attached to the holder, and wherein, in the sensing, the sensor senses current flowing through electric wires connected to two opposite sides of the holder when the protruding portions are inserted into the receiving recesses, thereby sensing attachment or detachment of the metal ball and the holder from each other.

15. The method according to claim 12, wherein the holder is provided with a hook switch configured to be turned on or off depending on attachment or detachment of the metal ball from the holder, and wherein, in the sensing, the sensor senses current flowing through an electric wire when the hook switch is turned on with attachment of the metal ball to the holder, thereby sensing attachment or detachment of the metal ball and the holder from each other.

* * * * *